United States Patent [19]

Taylor

[11] 4,377,374

[45] Mar. 22, 1983

[54] SPRING ACTUATED PISTON PUMP

[76] Inventor: Frederick J. Taylor, 41 Victory Rd., West Mersea, Essex, England

[21] Appl. No.: 260,217

[22] Filed: May 4, 1981

[30] Foreign Application Priority Data

Feb. 17, 1981 [GB] United Kingdom ..... 8104983

[51] Int. Cl.[3] ..... F01M 1/16

[52] U.S. Cl. ..... 417/228; 417/349; 60/605; 123/196 S; 184/6.3; 184/6.11

[58] Field of Search ..... 60/605; 417/228, 328, 417/349; 123/196 S, 196 R; 184/6.3, 6.4, 6.11, 6.16, 26

[56] References Cited

U.S. PATENT DOCUMENTS

| | | | |
|---|---|---|---|
| 1,769,258 | 7/1930 | Goodrich | 184/26 |
| 3,045,420 | 7/1962 | Addie et al. | 184/6.4 X |
| 3,138,221 | 6/1964 | Kofink et al. | 417/328 X |
| 3,583,525 | 12/1968 | Holcomb | 123/196 S X |
| 4,094,293 | 6/1978 | Evans | 123/196 S |
| 4,157,744 | 6/1979 | Capriotti | 60/605 X |

FOREIGN PATENT DOCUMENTS

| | | | |
|---|---|---|---|
| 2846975 | 5/1980 | Fed. Rep. of Germany | 60/605 |
| 52-68620 | 6/1977 | Japan | 184/6.11 |
| 1357236 | 6/1974 | United Kingdom | 184/6.3 |
| 1526929 | 10/1978 | United Kingdom | 417/328 |

*Primary Examiner*—Leonard E. Smith
*Attorney, Agent, or Firm*—McGlew and Tuttle

[57] ABSTRACT

A spring actuated piston pump for use in lubricating the bearings of a turbo-charger rotor, both on starting and stopping an associated internal combustion engine. The pump has a piston-and cylinder combination the piston of which is spring-urged towards the cylinder head, and there is a releasable catch arrangement operable on the piston to restrain movement of the piston towards the cylinder head when the piston is part-way between the extremes of its travel. The catch means is solenoid operated for connection to the engine starter system, so that the piston is released when the engine is started.

The pump chamber is connected to the engine lubrication system and the turbo-charger bearings through suitable ducts and one-way valves, so that on ordinary operation of the engine the pump chamber is full of oil with the piston fully retracted. On stopping the engine the piston moves under the spring bias discharging oil to the turbo-charger bearings until restrained by the catch arrangement. Subsequently on restarting the engine the piston is released so as to continue its movement under the spring bias again discharging oil to said bearings.

11 Claims, 2 Drawing Figures

SPRING ACTUATED PISTON PUMP

BACKGROUND OF THE INVENTION (1) Field of the Invention

This invention relates to pumps, and in particular to a pump having a piston and cylinder combination defining a pump chamber. The invention is especially concerned with such a pump arranged occasionally to deliver fluid such as lubricating oil on a single working stroke, rather than arranged for continuous operation.

(2) Description of the prior art

In an attempt to extract greater performance from internal combustion engines, and particularly diesel engines, it is now a common practice to provide an engine with an exhaust-gas-driven turbo-charger, so as to increase the volumetric efficiency of the engine. Turbo-chargers usually operate at very high rotational rates—typically of the order of 90,000 r.p.m.—and thus have stringent lubrication requirements. It is usual to supply lubricant to the bearings of the turbo-charger rotor from the engine lubricating oil system, but since the turbo-charger itself usually is some distance from the oil pump the engine lubrication system, there may be a considerable time lapse between the turbo-charger rotor starting to rotate and the delivery of oil to its bearings. Because the turbo-charger rotor starts to turn as soon as the engine first fires, the bearings of the rotor may be running relatively dry for some little while—typically 30 seconds, but in exceptional cases perhaps for 3 minutes.

This period of operation of the turbo-charger without a proper supply of lubricant has in the past frequently lead to the premature failing of the rotor bearings, and hence high operating costs on account of firstly the necessary repairs and secondly the out-of-service time of the engine. In an attempt to solve the above problem, I have proposed a design of single-shot oil pump for fitting to a turbo-charged engine, which pump performs a single oil-delivery stroke when the engine starter-motor is energised, so as to discharge oil directly to the bearings of the turbo-charger; subsequently on normal running of the engine, the pump is automatically recharged with oil supplied by the engine lubrication system. Such a pump has been described and claimed in the Specification of my prior British Pat. No. 1,526,929.

Though the pump described in my prior Patent Specification largely eliminates the problem discussed above on starting a turbo-charged engine, nevertheless experience has shown that premature bearing failure can still occur within a turbo-charger. My investigations have shown that in addition to the starting problem, a somewhat similar situation can arise on stopping a turbo-charged engine. This is because the supply of lubricating oil under pressure to the turbo-charger bearings collapses almost immediately the engine stops, though the turbo-charger rotor may continue to turn for some considerable while thereafter. In view of the very high temperatures prevailing in a turbo-charger when operating, any remaining oil film can break down before the rotor also has stopped, thus leaving the bearings with no lubrication—and the problem is exacerbated if the engine is revved immediately prior to being stopped, because then the rotational rate of the rotor as the engine stops will be much higher.

One solution to the above-stated problem would be to provide a second single-stroke pump somewhat similar to that described in my prior British patent specification No. 1,526,929, but modified so that its working stroke is performed on the engine stopping. However, such a solution would be expensive to implement, because two separate pumps would have to be provided and moreover the space required to accommodate a second pump may not be available in the somewhat restricted area of an engine compartment, particularly in the case of a commercial vehicle.

OBJECTS OF THE INVENTION

It is a general object of my invention to provide a pump suitable for use with a turbo-charged engine, in an attempt to solve both the starting and the stopping problems described above. It is a mere specific object of this invention to provide a lubrication device for a turbo-charger which permits delivery of oil to the turbo-charger on starting and stopping the engine.

Another object of the invention is to provide a single, unified single-shot pump assembly, able to deliver two measured charges of oil to a bearing, automatically when required.

A further object of the invention is to provide a relatively cheap and yet very reliable solution to the lubrication problems associated with turbo-charger bearings of an internal combustion engine.

SUMMARY OF THE INVENTION

In accordance with these and other objects, I have succeeded in producing a modified pump based on my prior design of pump as described in my British patent specification No. 1,526,929, which modified design may serve to deliver oil both on starting and on stopping an engine.

Accordingly, the broadest aspect of this invention provides a pump comprising a pump cylinder, a cylinder head mounted at one end of the pump cylinder, piston means having a piston crown and slidable axially within said pump cylinder, a pump chamber being defined between the crown of the piston and the cylinder head, and the piston means being slidable between a first position whereat said piston crown is adjacent said cylinder head and a second position whereat said piston crown is spaced from said cylinder head, biassing means to urge the piston means towards said first position and releasable catch means operable on said piston means to restrain movement of said piston means under the action of said biassing means when said piston means is at a third position which said third position is part-way between said first and second positions.

BRIEF DESCRIPTION OF THE DRAWINGS

A preferred specific embodiment of pump according to this invention, and a modification thereto, is described below and illustrated in the accompanying drawings, by way of example of the invention. In the accompanying drawings.

DESCRIPTION OF THE PREFERRED EMBODIMENTS

Figure 1:
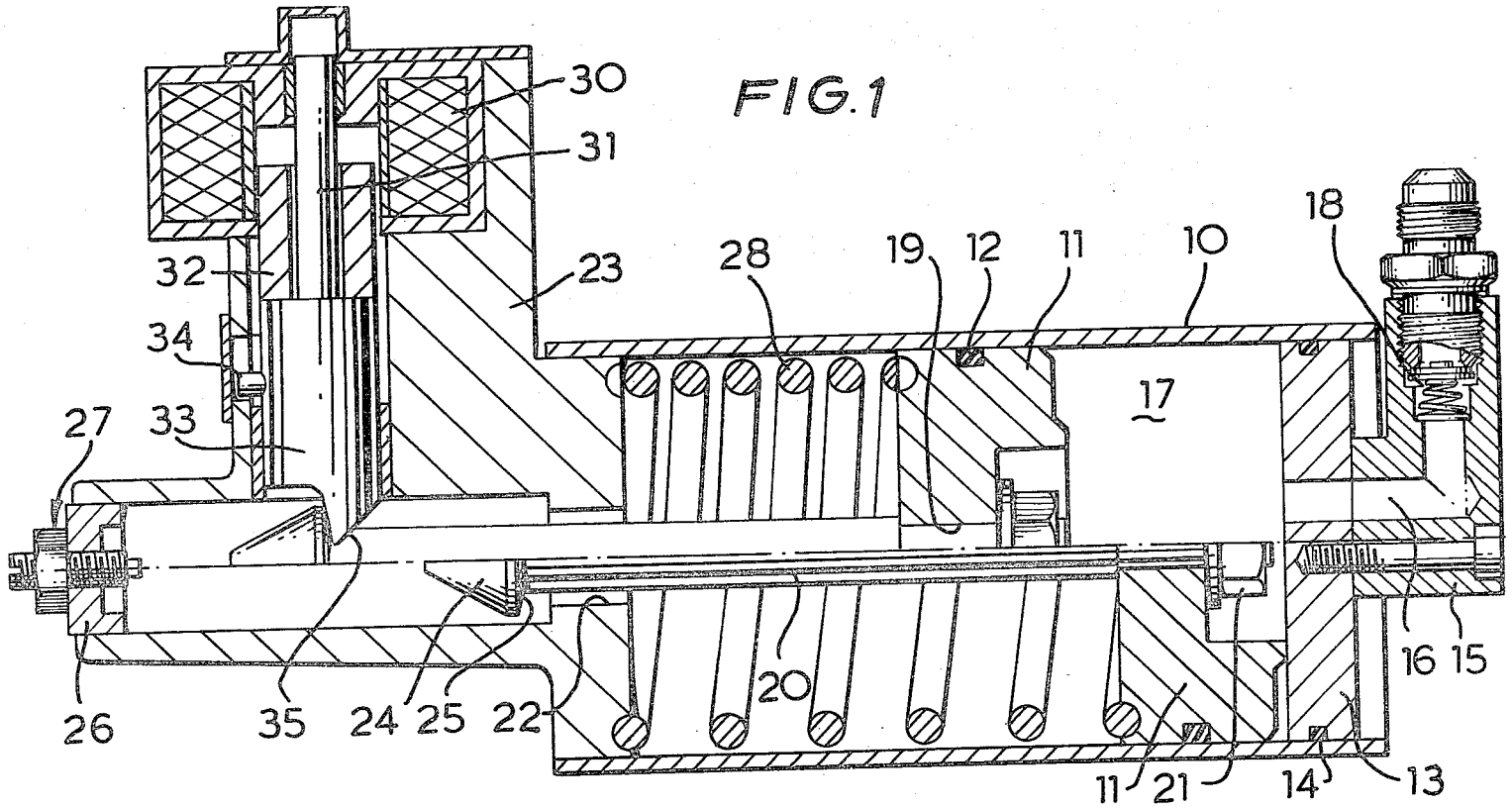
FIG. 1 is a cross-sectional view through a piston-and-cylinder pump of this invention, showing the piston thereof in two distinct positions.

When the pump of this invention as described above is to be used to lubricate the bearings of a turbo-charger rotor, the pump chamber is connected by suitable conduits both to the engine lubrication system and the turbo-charger rotor bearings, a one-way valve being provided at least between the lubricating system and the pump chamber. Moreover, the releasable catch means is suitably arranged to release the piston means on actuation of the engine starter motor, and the force exerted by the biassing means is appropriately selected such that the piston means may move to its second position against the bias thereof, under the action of lubricating oil delivered under pressure to the pump chamber by the engine lubrication system. It will thus be appreciated that when the pump is so arranged, the piston means will remain at its second position, with the pump chamber full of lubricating oil, so long as the engine is running normally. However, as the engine stops and the oil pressure collapses, the piston means will move under the action of its biassing means for its second position, gradually discharging oil from the pump chamber to the turbo-charger rotor bearings, until the piston means is arrested at its third position by the catch means. Subsequently, on re-starting the engine, the catch means is released to allow the piston means to move from its third position to its first position, again under the action of the biassing means, thus discharging more oil out of the pump chamber to the turbo-charger rotor bearings.

It will be realised that when a pump of this invention is fitted in the manner described to a turbo-charged internal combustion engine, the pump ensures delivery of oil to the turbo-charger rotor bearings at the two times when those bearings otherwise may be running dry, leading to premature failure thereof. Thus, by employing the pump of this invention, considerably greater life may be expected from the bearings of a turbo-charger rotor.

The releasable catch means employed in the pump of this invention preferably is electromagnetically-operated. Conveniently, a solenoid is mounted on the pump cylinder on the end thereof remote from the cylinder head, which solenoid actuates a catch member engageable with and releasable from an abutment provided on the piston means when at its third position. For example, the solenoid may have an armature which directly carries the catch member, but preferably the solenoid has an armature which actuates the catch member through a linkage the design of which may be modified to suit the particular characteristics of a given size and design of pump. Such an indirect arrangement may also be useful in maintaining the overall radial size (considered about the cylinder axis) of the pump as small as possible.

The combination of the cylinder including the cylinder head and the piston of the piston means may essentially be conventional and any suitable design may be employed for this purpose. Apertures into the pump chamber should be provided so that conduits to feed lubricant to the pump chamber and to take pumped lubricant away therefrom can suitably be connected thereto. Such apertures are preferably provided through the cylinder head itself, which head may then incorporate one-way valves to ensure the flow of lubricant through the pump chamber in the correct sense. Thus, a conduit from the engine lubrication system would be connected to that aperture having a one-way valve allowing lubricant to enter the pump chamber and, similarly, the pumped lubricant conduit which is connected to the turbo-charger oil-ways should be connected to that aperture which has a one-way valve allowing pumped lubricant to leave the pump chamber—but in some circumstances the latter one-way valve may not be necessary.

In the preferred embodiment of this invention, the piston means comprises a piston and piston rod combination, the piston rod extending axially of the piston away from the cylinder head and formed with an abutment at its free end which abutment serves as a part of the catch means. The catch means should have a catch member engageable with said abutment, such as a pin slidable radially outwardly for instance under the action of a solenoid so as to become released from the abutment, thereby releasing the piston means to allow the piston means to move from said third position to said first position, under the influence of the biassing means. The abutment and catch member of the catch means should however be configured so as to permit the piston means to move from its first position to its second position—and this is conveniently arranged by providing ramp surfaces on the parts of the abutment and catch member which inter-engage on the piston means moving away from the cylinder head.

Reference now will be made to the accompanying drawings which illustrate a specific form of pump embodying the preferred features described above. In FIG. 1, there is shown a cylinder 10 having a piston 11 slidably mounted therein for movement along the axis of the cylinder. The piston 11 is provided with an O-ring seal 12 for effecting an oil-tight seal between the piston 11 and the internal wall of the cylinder 10.

A cylinder head 13 is mounted within the cylinder 10 at one thereof, and is also provided with an O-ring seal 14 to prevent oil leakage between the head 13 and the cylinder 10. The cylinder head 13 may be secured in position for example by means of radial bolts (not shown) passing through appropriately-positioned holes in the cylinder into threaded holes in the head. Attached to the external face of the cylinder head 13 is a connector block 15 having an inlet passage 16 and a similar outlet passage (not shown). The two passages communicate with apertures through the cylinder head 13, to allow the flow of lubricant to and from the pump chamber 17 of the pump. The inlet passage 16 is provided with a one-way valve 18, allowing the flow of lubricant into the pump chamber 17, but blocking the flow of lubricant out of the chamber. The cylinder head 13 and connector block 15 may be formed as a one-piece casting, if required.

The piston 11 has an axial bore 19, through which extends a piston rod 20. A shoulder is provided on the piston rod and the piston is clamped between the shoulder and a nut 21 threaded on to the end of the rod. The other end of the piston rod extends through a bore 22 provided in an end casting 23, attached to the end of the cylinder 10 remote from the cylinder head 13. The end of the piston rod 20 remote from the piston 11 is provided with an enlarged head 24 which head is generally conical in shape, there being an abutment 25 defined by the step between the head 24 and the piston rod 20. The casting 23 is extended away from the cylinder head 13 to an extent sufficient to accommodate the abutment 24 when the piston 11 is at its left-most position (in FIG. 1) the casting 23 having an end cap 26 provided with an adjustable end stop 27, to limit leftward movement of the piston 11.

Provided within the cylinder 10 between the piston 11 and the casting 23 is a helical compression spring 28, urging the piston 11 towards the cylinder head 13. The spring rate of the spring 28 is selected such that the force exerted thereby on the piston 11 when the piston is at its most leftward position is smaller than—though comparable in magnitude with—the force exerted on the piston by lubricant delivered under pressure from an engine lubrication system through the conduit 16. Moreover, the physical size of the spring 28 should be such that when the end stop 27 is fully released, the turns of the spring 'bind,' to limit leftward movement of the piston before the enlarged head 24 engages the end cap 26.

Mounted on the casting 23 is a solenoid assembly, comprising an electro-magnet coil 30 and an armature 31 slidably mounted for movement in a direction generally radial to the axis of the cylinder. The armature comprises a pole-piece 32 and a catch member 33 the inner end of which is engageable with the abutment 25 defined by the enlarged head 24 on the end of the piston rod 20. A pin 34 serves to restrain rotation of the catch member 33 and hence the armature 31 also about their own axes, and the radially-inner end of the catch member is provided with a ramp face 35 engageable by the conical face of the enlarged head 24, on leftward movement of the piston 11.

In use of the pump with a turbo-charged engine, the inlet passage 16 is connected to a high pressure lubricating oil system, such as is used for lubricating the main and big end bearings of the engine, and the outlet passage is connected to those parts of the turbo-charger to be lubricated as soon as the starter motor of the engine is operated—thus for example to the bearings carrying the turbo-charger rotor. The solenoid coil 30 is wired into the starter motor circuit of the engine, so that the solenoid is energised when the starter motor is operated. When the engine is operated normally, oil under pressure is supplied to the passage 16 to enter the pump chamber 17 and to drive the piston away from the cylinder head 13, against the bias provided by the spring 28, until the piston reaches its most leftward position, limited by the end stop 27. All the time the engine continues to operate, the piston 11 is held by the oil pressure at this third position (not illustrated). It will be appreciated that on the piston 11 moving to its third position from its initial, or first, position (shown in the lower half of FIG. 1) the enlarged head 24 passes the catch member 23. As this occurs, the conical face of the enlarged head 24 and the ramp face 35 inter-engage, causing the catch member 33 to lift and ride over the enlarged head 24.

As the engine stops, the delivery of oil to the pump ceases and the spring bias then urges the piston 11 towards the right, away from its second position, thereby discharging lubricating oil from the pump chamber 17 to the bearings of the turbo-charger. When the piston reaches its third position (shown in the upper half of FIG. 1) further movement under the action of spring 28 is arrested by the inter-engagement of the abutment 25 of the enlarged head 24 and the catch member 33. The pump thus remains in this partially-charged state, in readiness for the next starting sequence.

Because the solenoid 30 is appropriately coupled to the starter motor circuit of the engine, when the starter motor is actuated so also is the solenoid 30, thus raising the catch member 33. This frees the enlarged head 24, allowing the piston 11 to move to the right once more under the action of the spring 28, discharging oil from the pump chamber 17 to the bearings of the turbo-charger, until the piston returns to its first position, in engagement with the cylinder head 13. Then, on the supply of lubricating oil under pressure being established again, the piston 11 is moved leftward once more, to its second position, filling the pump chamber with oil.

Figure 2:
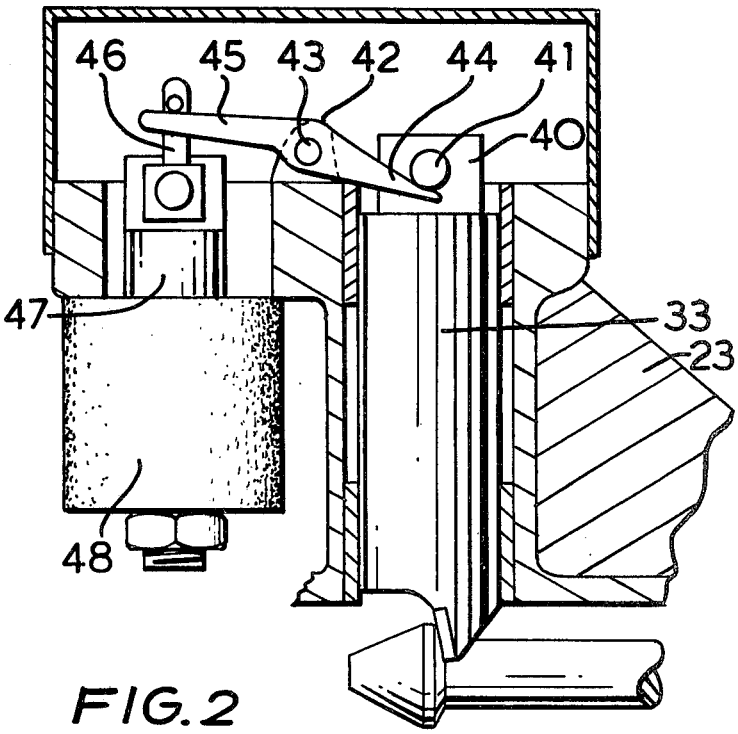
FIG. 2 is a detailed view of a modification to the pump of FIG. 1.

FIG. 2 shows a modified form of the solenoid arrangement, allowing the use of a more powerful solenoid without increasing the overall radial dimension of the pump assembly. In this arrangement, the catch member 33 is provided at its upper end with a fork 40, a pin 41 extending through aligned bores in the blades of the fork. An operating lever 42 is journalled on pin 43 such that one arm 44 of the lever engages the underside of the pin 41. The other arm 45 of the lever is engaged by a link 46 pivotted to the armature 47 of a solenoid assembly 48, mounted on the end casting 23 and arranged so that the link 46 is pulled downwardly on energisation of the solenoid.

It will be appreciated that the modified arrangement shown in FIG. 2 not only allows the use of a more powerful solenoid without greatly increasing the radial dimension of the pump but moreover can be arranged to provide a considerable mechanical advantage, by appropriate dimensioning of the lever 42 and positioning of its pivot pin 43.

The amount of lubricating oil delivered by the pump described above may easily be set during the manufacture thereof, by appropriate positioning of the holes (not shown) through the cylinder 10, through which the bolts pass to secure the cylinder head 13 in position. Moreover, the amount of oil delivered on stopping the engine can also be adjusted, by appropriate setting of the end stop 27.

I claim:

1. A pump comprising a pump cylinder, a cylinder head mounted on one end of the pump cylinder, a piston slidably mounted within said pump cylinder for movement between a first position adjacent said cylinder head and a second position spaced from said cylinder head, said piston having a piston crown facing said cylinder head thereby defining in conjunction with said pump cylinder and said cylinder head a pump chamber, the cylinder head being provided with two apertures respectively to allow the ingress of liquid to and ejection of liquid from said pump chamber on movement of said piston, there being spring biassing means acting on said piston to urge said piston towards said cylinder head, a piston rod mounted on said piston and extending axially thereof away from said cylinder head, an abutment provided on said piston rod and a catch member movably mounted on said pump cylinder so as to be co-operable with said abutment when said piston is at a third position part-way between said first position and said second position, to restrain movement of the piston towards said first position under the action of said spring biassing means, a solenoid being provided on said pump cylinder to effect movement of said catch member thereby to release said piston when said solenoid is energised.

2. A pump according to claim 1, wherein said solenoid has an armature slidably mounted for movement radially of said pump cylinder, the radially-outer end of said armature being connected to one arm of a first-order lever the other arm of which is connected to said catch member and said lever being pivotted between its two said arms, said armature being moved radially inwardly of the pump cylinder on energisation of said solenoid, thereby moving said catch member radially outwardly and releasing said abutment associated with said piston means to allow said piston means to move from its said third position to its said first position.

3. A pump according to claim 1, wherein screw threaded adjuster means are provided to limit movement of said piston against the action of said spring biassing means, thereby to permit adjustment of the volumetric delivery of the pump on movement of said piston from its said second position to its said third position.

4. A pump comprising a pump cylinder, a cylinder head mounted at one end of the pump cylinder, piston means having a piston crown and slidable axially within said pump cylinder, a pump chamber being defined between the crown of the piston and the cylinder head, and the piston means being slidable between a first position whereat said piston crown is adjacent said cylinder head and a second position whereat said piston crown is spaced from said cylinder head, biassing means to urge the piston means towards said first position and releasable catch means operable on said piston means to restrain movement of said piston means under the action of sid biassing means when said piston means is at a third position which said third position is part-way between said first and second positions.

5. A pump according to claim 4, wherein electromagnetic control means is provided to effect release of said catch means from said piston means.

6. A pump according to claim 4 or claim 5, wherein two apertures are provided through the cylinder head to allow the respective connection of liquid supply and delivery ducts thereto, and two out-way valves are incorporated one in each of said apertures respectively, to allow uni-directional liquid flow through the pump when in operation.

7. A pump according to claim 5, wherein a solenoid is mounted on said pump cylinder remote from said cylinder head, and said catch means includes a catch member engageable with and releasable from an abutment provided on the piston means when at said third position, the catch member being connected to said solenoid for operation thereby.

8. A pump according to claim 7, wherein said solenoid has an armature which actuates said catch member indirectly through a linkage which may be adapted to suit the operating characteristics of the pump.

9. A pump according to claim 7, wherein the piston means comprises a piston and piston rod combination, the piston rod extending axially of the piston away from said cylinder head and formed with said abutment at its free end for co-operation with said catch member.

10. A pump according to claim 9, wherein said catch member is slidably mounted in the pump cylinder for radial sliding movement.

11. A pump according to claim 10, wherein said abutment and catch member are provided with respective ramp surfaces arranged to co-operate on movement of the piston means from its first position to its second position, to allow the catch member to ride over said abutment but to limit movement of said piston means from said second position towards said first position when said piston means is at its third position other than when said catch means is released.

* * * * *